United States Patent [19]

Izatt et al.

[11] Patent Number: 4,477,377

[45] Date of Patent: Oct. 16, 1984

[54] RECOVERY OF CESIUM

[75] Inventors: Reed M. Izatt; James J. Christensen, both of Provo; Richard T. Hawkins, Orem, all of Utah

[73] Assignee: Brigham Young University, Provo, Utah

[21] Appl. No.: 389,402

[22] Filed: Jun. 17, 1982

[51] Int. Cl.[3] ..... G21F 9/04; G21F 9/12

[52] U.S. Cl. ..... 252/631; 210/643; 210/650; 210/651; 252/634

[58] Field of Search ..... 252/631, 634; 210/643, 210/649, 650, 651

[56] References Cited

U.S. PATENT DOCUMENTS

| | | | |
|---|---|---|---|
| 4,196,169 | 4/1980 | Gablin et al. | 252/631 |
| 4,230,597 | 10/1980 | Bustard et al. | 252/631 |
| 4,363,765 | 12/1982 | Fiato et al. | 260/429 R |

OTHER PUBLICATIONS

Jacobs, D., 1962, Cesium Exchange Properties of Vermiculite, Nuclear Science and Engineering, 12:285–292.

A. Zinke & E. Ziegler, Zur Kenninis des Hartungsporzesses, vol. 77, 1944, pp. 264–273, Chem. Ber.

J. D. Lamb, R. M. Izatt, J. J. Christensen, D. J. Eatough, Coordination Chemistry of Macrocyclic Compounds, ed. by G. A. Melson, Plenum, 1979.

C. D. Gutsche, R. Muthukrishnan, Calixarenes. 1. Analysis of the Product Mixtures Produced by the Base–Catalyzed Condensation of Formaldehyde with Para–Substituted Phenols, 1978, pp. 4905–4906, J. Org. Chem., vol. 43.

H. Kammerer & G. Happel, Stufenweise Darstellung Eines Cycloheptamers aus p–Kresol, 4–tert–Butylphenol und Formaldehyd. Vergleich mit Einem Phenolischen, Heptanuklearen Kettenoligomer, 1980, pp. 2049–2062, Makromol. Chem., vol. 181.

A. Ninagwa & H. Matsuda, Isolation and Characterization of Calix[5]Arene from the Condensation Product of 4–tert–Butylpheol with Formaldehyde, 1982, pp. 65–67, Makromol. Chem. Rap. Comm., vol. 3.

C. D. Gutsche, B. Dhawan, K. H. No, & R. Muthukrishnan, Calixarenes 4. The Synthesis, Characterization, and Properties of the Calixarenes from P–tert–Butylphenol., 1981, pp. 3782–3792, J. Am. Chem. Soc., vol. 103.

E. M. Choy, D. F. Evans, E. L. Cussler, A Selective Membrane for Transporting Sodium Ion Against Its Concentration Gradient, 1974, pp. 7085–7090, J. Am. Chem. Soc., vol. 96.

*Primary Examiner*—Brooks H. Hunt
*Assistant Examiner*—Howard J. Locker

[57] ABSTRACT

A process of recovering cesium ions from mixtures of ions containing them and other ions, e.g., a solution of nuclear waste materials, which comprises establishing a separate source phase containing such a mixture of ions, establishing a separate recipient phase, establishing a liquid membrane phase in interfacial contact with said source and recipient phases, said membrane phase containing a ligand, preferably a selected calixarene as depicted in the drawing, maintaining said interfacial contact for a period of time long enough to transport by said ligand a substantial portion of the cesium ion from the source phase to the recipient phase, and recovering the cesium ion from the recipient phase. The separation of the source and recipient phases may be by the membrane phase only, e.g., where these aqueous phases are emulsified as dispersed phases in a continuous membrane phase, or may include a physical barrier as well, e.g., an open-top outer container with an inner open-ended container of smaller cross-section mounted in the outer container with its open bottom end spaced from and above the closed bottom of the outer container so that the membrane phase may fill the outer container to a level above the bottom of the inner container and have floating on its upper surface a source phase and a recipient phase separated by the wall of the inner container as a physical barrier. A preferred solvent for the ligand is a mixture of methylene chloride and carbon tetrachloride.

8 Claims, 4 Drawing Figures

RECOVERY OF CESIUM

INTRODUCTION

The present invention relates to recovery of cesium ions from mixtures thereof with other ions by establishing a separate basic source phase containing the ions to be separated, including cesium ions, a separate recipient phase and a liquid membrane phase containing a macrocyclic polyphenol (calixarene) ligand in a liquid membrane solvent interfacing with said source and recipient phases, maintaining the interface contact for a period of time long enough to transport a substantial part of the cesium ions from the source phase to the recipient phase and recovering the cesium ions from the recipient phase. The process may be referred to as the selective transport of $Cs+$ through a liquid membrane by a macrocyclic polyphenol or calixarene ligand.

BACKGROUND OF THE INVENTION

The cyclic polyphenols comprising a ring of monomer units having the structures depicted in the drawing, first reported by A. Zinke and E. Ziegler, Chem. Ber., 77, 264–272 (1944), are somewhat similar in structure to the cyclic polyethers and other macrocyclic ligands which are characterized by their size-related selectivity in binding cations noted in J. D. Lamb, R. M. Izatt, J. J. Christensen, D. J. Eatough, COORDINATION CHEMISTRY OF MACROCYCLIC COMPOUNDS, edited by G. A. Melson, Plenum, pages 145–217 (1979). The synthetic chemistry of compounds of this type has received careful study, expecially by Gutsche and his coworkers, who have designated these compounds calixarenes, C. D. Gutsche, R. Muthukrishnan, J. Org. Chem. 43, pages 4905–4906 (1978). Synthesis of cyclic heptamers of similar structure has been reported by H Kammerer and G. Happel, Makromol.-Chem. 181, pages 2049–2062 (1980) and of cyclic pentamers by A. Ninagwa and H. Matsuda, Makromol.-Chem.Rat.Comm.3, pages 65–67 (1982). The oligomeric hexameric and tetrameric compounds depicted in the drawing have been described by C. D. Gutsche, B. Dhawan, K. H. No and R. Muthukrishnan, J. Am. Chem.Soc.,103, pages 3782–3792 (1981). Such compounds are Bronsted-Lowry acids which E. M. Choy, D. F. Evans, E. L. Cussler, J. Am.Chem.Soc.,96, pages 7085–7090 (1974) used successfully to drive the flux of $Na+$ against the concentration gradient of monensen.

SUMMARY OF THE INVENTION

The invention is based on the discovery that calixarenes are very effective as membrane carriers of cesium cations. They are characterized by a high degree of transport selectivity for $Cs+$ over other alkali metal cations, a low solubility in water, which minimizes loss to adjacent water phases, and the formation of neutral cation complexes through loss of a proton so that the anion does not need to accompany the cation through the membrane. This latter property makes it possible to couple the transport of cations in the reverse flux of protons through the membrane.

BRIEF DESCRIPTION OF THE DRAWING

The invention will be described and illustrated by reference to the drawing in which.

DESCRIPTION OF PREFERRED EMBODIMENTS OF THE INVENTION

Figure 2:
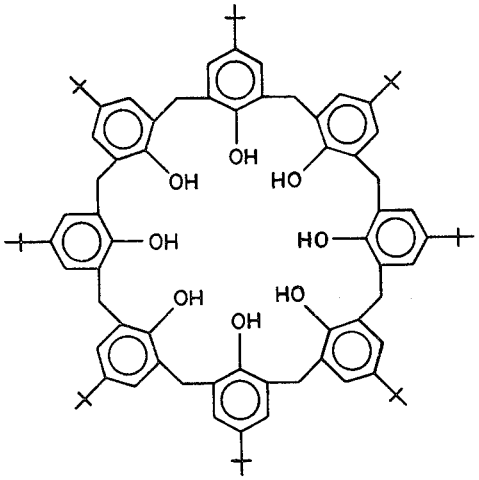
FIGS. 2, 3 and 4 represent the molecular structure of calix[8]arene, calix[6]arene and calix[4]arene, respectively, which are used in the process of the invention.
Figure 3:
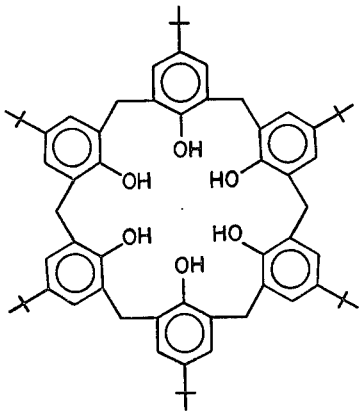
Figure 4:
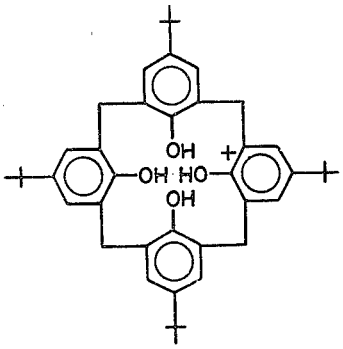

The process of the invention relates to the recovery of cesium ions from mixtures thereof with other metal ions. Nuclear waste represents a rich source of cesium but it is admixed with many other metals closely related in molecular weight and/or chemical properties which make separation difficult by conventional separation procedures. The present invention accomplishes this separation effectively and efficiently. The separation procedure of the invention involves the transport of cesium ions from a separate source phase to a separate recipient phase through a liquid membrane containing the calixarene which interfaces with the two separate phases. The cyclic octamer of FIG. 2, the cyclic hexamer of FIG. 3 and the cyclic tetramer of FIG. 4 all exhibit the property of selectively complexing with $Cs+$ under basic conditions.

Figure 1:
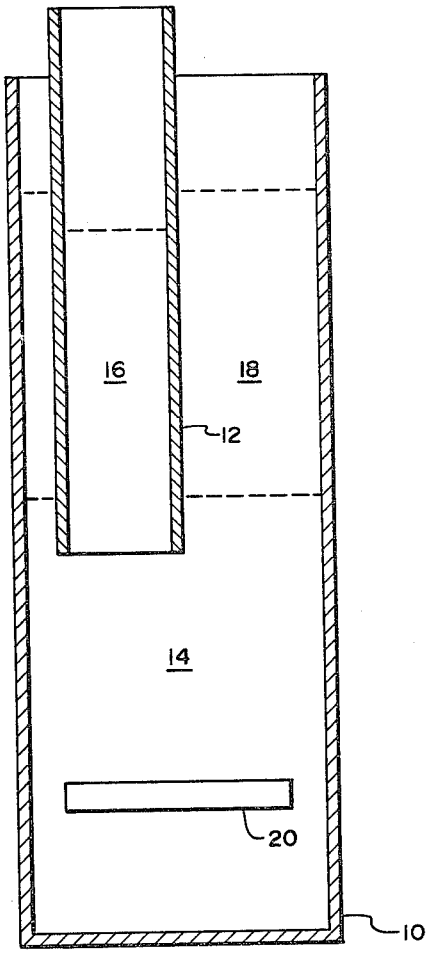
FIG. 1 is a diagrammatic representation of one form of apparatus adapted for use in the process of the invention.

A suitable apparatus in which the process of the invention can be carried out is shown in FIG. 1 in which 10 is an open-top outer container, 12 is an open-ended inner container located within container 10 with its open bottom spaced above the closed bottom of the outer container, 14 is a layer of liquid membrane containing the calixarene deep enough to cover the open bottom end of the inner container 12, 16 is a body of aqueous solution of the metal ions to be separated located in the inner container 12 and 18 is an aqueous recipient phase located in the outer container 10 above the level of the liquid membrane. A stirring means, e.g., a magnetic stirrer 20 may be included, if desired. In this apparatus the source phase is separated from the recipient phase by the liquid membrane phase and by a physical barrier, the open-ended inner container. The containers may be made of any suitable material such as metal, glass, plastic and the like.

In the use of this apparatus the cesium ions are selectively removed from the body 16 of aqueous solution containing them by the calixarene in phase 14 across the interface between phases 14 and 16 and are delivered from the calixarene to the aqueous recipient phase 18 across the interface between phases 16 and 18.

The process of the invention is not dependent upon this apparatus, however, because the process can be carried out in any apparatus which provides means for holding (1) a separate aqueous phase containing the metal ions to be separated, (2) a separate aqueous recipient phase and (3) a membrane phase which separates and interfaces with the other two phases. For example the phases may be in any kind of container as an emulsion of the two separate phases as dispersed phases in a continuous organic liquid phase containing the ligand. In such apparatus the source phase is separated from the recipient phase only by the liquid membrane phase.

The separate aqueous phase containing the metal ions to be separated may be prepared in any suitable manner from any starting material having metal values which it is desired to recover in whole or in part. A starting material of great potential value is nuclear waste which contains a plurality of degradation products of uranium splitting and which have molecular weights about half of the molecular weight of the uranium, including cesium.

The membrane phase containing the ligand in a suitable hydrophobic organic solvent may be prepared in any suitable manner from liquids known in the art to be useful for this purpose, e.g., any of those mentioned in J. D. Lamb, J. J. Christensen, J. L. Oscarson, B. L Nielsen, B. W. Asay and R. M. Izatt, J. Am. Chem. Soc., 102, pages 6820-6824 (1980).

The recipient phase may be distilled, deionized water.

The three liquid phases, after preparation, are placed in the apparatus in which the process is to be carried out.

In the apparatus without barrier separation between the source and recipient phases, the source phase and the recipient phase are emulsified with the membrane phase in any suitable container for the emulsion.

In the apparatus illustrated in FIG. 1 the membrane phase is first introduced into container 10 until it covers the lower end of tube 12, as illustrated in FIG. 1, the source phase is introduced into the tube 12 and the recipient phase into the container, both floating on the membrane phase and separated by the tube 12. The transport of the cesium ion from the source phase to the recipient phase then takes place through the membrane phase by means of the selective ligand over a long enough period of time for substantially complete removal of the cesium ion from the source phase and its delivery to the recipient phase.

WORKING EXAMPLES

Three liquid membranes are prepared by dissolving enough of each calixarene in an organic liquid membrane solvent containing the various percentages of methylene chloride and carbon tetrachloride set forth in TABLE I to form a 1.0 mM solution.

TABLE I

| CALIXARENE | PERCENTAGE METHYLENE CHLORIDE | PERCENTAGE CARBON TETRACHLORIDE |
|---|---|---|
| 1. Tetramer | 25 | 75 |
| 2. Hexamer | 18 | 82 |
| 3. Octamer | 16 | 84 |

Into each of three 4-dram vials 10 mL of each solution is poured, which is enough to cover the lower end of glass tube 12. Atop this organic liquid are placed (1) in the tube 12 0.8 mL of a source phase containing the ions to be separated, including cesium and other ions indicated in TABLE II, and (2) in the space in container 10 outside tube 12 5.0 mL of distilled, deionized water. After 24 hours the recipient phase is sampled and analyzed for cation concentration by atomic absorption spectrometry. Three runs are made of each calixarene and the results averaged. The standard deviation among the values in each run is less than 15%. The results are given in TABLE II.

TABLE II

| Source | | Transport Rate (moles × $10^7$/24 hours) | |
|---|---|---|---|
| Phase | 1 | 2 | 3 |
| LiOH | c | 4.4 + 0.5 | 0.9 + 0.1 |
| NaOH | 0.9 + 0.1 | 1.4 + 0.7 | 1.5 + 0.1 |
| KOH | 45 + 12 | 28 + 7 | 1.7 + 0.6 |
| RbOH | 35 + 13 | 70 + 40 | 22 + 5 |
| CsOH | 61 + 2 | 360 + 50 | 130 + 15 |
| Ca(OH) | 0.3 + 0.03 | c | 0.5 + 0.1 |
| Sr(OH) | 0.11 + 0.7 | 0.3 + 0.1 | 0.13 + 0.03 |

TABLE II-continued

| Source | | Transport Rate (moles × $10^7$/24 hours) | |
|---|---|---|---|
| Phase | 1 | 2 | 3 |
| Ba(OH) | 0.7 + 0.3 | 1.4 + 0.7 | 0.17 + 0.02 |

c = less than 0.4 moles × $10^7$/24 hours

TABLE II demonstrates that the calixarene ligands are effective carriers of the heavier monovalent alkali metal cations. All three gave selective transport of Cs+ over all other cations. The tetramer is least selective for Cs+ and shows greater affinity than either of the other ligands for K+. While the invention does not depend on the reason or hypothesis for the differences in selectivity it may be noted that the three ligands vary considerably in the size of their central cavity. Comparison of the relative magnitudes of the radii for the cations and these ligands makes it apparent that the selectivities seen in TABLE II are determined by factors other than relative sizes. CPK models indicate that the cavity radii of the ligands are: tetramer 1.36-1.84 Å; hexamer 4.3-5.6 Å; octamer 8.0-8.8 Å. The radii of Cs+, Rb+ and K+ are 1.70, 1.49 and 1.38 Å, respectively, R. D. Shannon and C. T. Prewitt, Acta Crystallogr., B25, pages 969 et seq. (1969). It is likely that M+ selectivity is related to the relative hydration energies of the cations studied, since partial or complete dehydration of the cation will occur in the complexation process. This hypothesis is supported by the fact that srongly hydrated divalent cations show almost no transport, while among the monovalent cations the least strongly hydrated cation, Cs+, is selected.

Experiments were carried out using calix[8]arene to measure the rate of Cs+ transport under conditions of varying source pH to demonstrate the exchange of a proton for the cation at the source phase interface. Mixtures of $CsNO_3$ and CsOH were used as the source phase. The relative amounts of the two solutes were adjusted to maintain the total Cs+ concentration at 1.00M in each case. The values of the transport rate are small below pH of 12 but rise rapidly beyond this point. This result confirms that a proton is removed from the ligand in the complexation process and that for appreciable transport to take place, the source phase must be quite basic.

Although the invention has been described and illustrated by reference to certain specific calixarenes, additional analogs of these calixarenes are within the scope of the invention and with groups other than butyl in the para position of the phenol moiety which may serve to alter the acidity of the phenolic OH and thus the cation binding characteristics of the ligand.

Having thus described and illustrated the invention, what is claimed is:

1. The process of recovering cesium ions in higher concentration from mixtures thereof with other ions which comprises (1) establishing a separate aqueous source phase of the ions to be separated of basic pH, (2) establishing a separate aqueous recipient phase, (3) establishing a liquid membrane phase containing a macrocyclic calixarene ligand in a liquid membrane solvent interfacing with the source phase and the recipient phase, (4) maintaining this interfacial contact for a period of time long enough to transport a substantial part of the cesium ions from the source phase to the recipient phase, and (5) recovering the cesium ions from said recipient phase.

2. The process as set forth in claim 1 in which the liquid membrane solvent is a mixture of methylene chloride and carbon tetrachloride.

3. The process as set forth in claim 1 in which the ions to be separated are derived from nuclear waste which contains a plurality of degredation products of uranium splitting which have molelcular weights about half of the molecular weight of uranium.

4. The process as set forth in claim 1 in which the ligand is the tetrameric calixarene.

5. The process as set forth in claim 1 in which the ligand is the hexameric calixarene.

6. The process as set forth in claim 1 in which the ligand is the octameric calizarene.

7. The process as set forth in claim 1 in which the source phase is separated from the recipient phase by the liquid membrane phase and by a solid physical barrier.

8. The process as set forth in claim 1 in which the source phase is separated from the recipient phase by the liquid membrane only.

* * * * *